US008540243B2

(12) United States Patent
Tanaka et al.

(10) Patent No.: US 8,540,243 B2
(45) Date of Patent: Sep. 24, 2013

(54) PINCH ROLLER LIFTING MECHANISM

(75) Inventors: Ippei Tanaka, Hamamatsu (JP); Yuichi Sugiyama, Hamamatsu (JP)

(73) Assignee: Roland DG Corporation, Hamamatsu-Shi (JP)

( * ) Notice: Subject to any disclaimer, the term of this patent is extended or adjusted under 35 U.S.C. 154(b) by 217 days.

(21) Appl. No.: 13/241,186

(22) Filed: Sep. 22, 2011

(65) Prior Publication Data

US 2012/0228089 A1 Sep. 13, 2012

(30) Foreign Application Priority Data

Mar. 9, 2011 (JP) ..... 2011-051997

(51) Int. Cl.
*B65H 5/04* (2006.01)

(52) U.S. Cl.
USPC ..... 271/273; 271/2; 193/35 SS; 198/608

(58) Field of Classification Search
USPC ..... 198/608, 612, 621.3, 624, 782, 606, 198/607, 613, 624.4; 193/35 SS; 271/117, 271/118, 253, 171, 273, 274; 399/393–395
See application file for complete search history.

(56) References Cited

U.S. PATENT DOCUMENTS 4,673,279 A * 6/1987 Brown ..... 399/402
6,595,516 B2 * 7/2003 Kallin et al. ..... 271/273
2006/0220294 A1 * 10/2006 Sye ..... 271/2

* cited by examiner

*Primary Examiner* — Gene Crawford
*Assistant Examiner* — Lester Rushin
(74) *Attorney, Agent, or Firm* — Lee, Hong, Degerman, Kang & Waimey

(57) ABSTRACT

The present invention is related to a pinch roller lifting mechanism. The pinch roller lifting mechanism includes drive rollers for holding and transferring a medium, the drive rollers arranged adjacent to each other along a first axis, pinch rollers for holding the medium with the drive rollers, a plate-like member extending along the first axis, wherein the plate-like member includes an opening, a support member having a first end section on which the pinch rollers are provided, a cam slidably provided on the plate-like member, the cam comprising a guide section that abuts against a second end section of the support member and engages the opening of the plate-like member, a pulley operationally connected to a drive motor for pulling the plate-like member in a first direction, and a spring that biases the plate-like member in a direction opposite to the first direction.

11 Claims, 11 Drawing Sheets

PINCH ROLLER LIFTING MECHANISM

CROSS-REFERENCE TO RELATED APPLICATIONS

Pursuant to 35 U.S.C. §119(a), this application claims the benefit of earlier filing date and right of priority to Japanese Application No. 2011-051997, filed on Mar. 9, 2011, the contents of which are hereby incorporated by reference herein in its entirety.

FIELD OF THE INVENTION

The present invention relates to a pinch roller lifting mechanism and, more particularly, to a pinch roller lifting mechanism used in connection with a printing apparatus.

BACKGROUND OF THE INVENTION

A prior printing apparatus performs desired printing on a medium, such as recording paper. The printing apparatus prints by ejecting ink from an ink head that is moved in a direction perpendicular to a transfer direction of the medium. Such a printing apparatus may be provided with a plurality of transfer mechanisms, each including drive rollers and pinch rollers formed over a platen that extends in the moving direction of the ink head, and linearly arranged at predetermined intervals.

The drive rollers forming the transfer mechanism are each rotated by a drive motor, and the pinch rollers are brought into elastic contact with the drive rollers. A medium that is held between the drive rollers and the pinch rollers is transferred by the rotation of the drive rollers in the transfer direction.

Notably, the printing apparatus equipped with the transfer mechanism having the structure described above is susceptible to problems. For example, unless the medium is set correctly with respect to the transfer direction, wrinkles form on the medium and jamming of the medium in the printing apparatus occurs. Hence, if the medium is skewed at the time of setting the medium in the printing apparatus, the medium must be removed from, and reset at, the transfer mechanism. Accordingly, the prior printing apparatus is problematic due to the complication involved with setting the medium in the transfer mechanism.

In a previous attempt to solve the problems of the prior printing apparatus, a printing apparatus has been provided wherein all pinch rollers in respective transfer mechanisms can be moved up and down at the same time. Each of the transfer mechanisms includes a pinch roller lever that is rotatable about a supporting shaft. A pinch roller is provided at a front end of the pinch roller lever, and a shaft is provided at a rear section of the pinch roller lever. The shaft, as it is rotated, pushes the rear section of the pinch roller lever, thereby raising the front end of the pinch roller lever.

The shafts for the respective transfer mechanisms each have a rectangular or oval cross-sectional shape, and are formed as one piece. When the shaft is rotated, the pinch roller is raised or brought down at each of the transfer mechanisms. When an operator rotates the shaft as necessary, the shaft pushes the rear section of the pinch roller lever, thereby raising a front tip of the pinch roller lever and raising the pinch roller such that an elastic contact state between the pinch roller and drive roller is released.

Accordingly, when the orientation of the medium is to be corrected at the time of setting the medium, the shaft is rotated to raise the pinch rollers, and the orientation of the medium is corrected. Thereafter, the shaft is rotated again to lower the pinch rollers, whereby the medium can be held between the drive rollers and the pinch rollers in a proper state.

However, according to the previously-described printing apparatus, the pinch rollers are raised or lowered by the operator. If the operator does not have the requisite experience to operate the printing apparatus, the operation of raising and lowering the pinch rollers cannot be performed properly. Consequently, if the orientation of the medium is corrected in a state in which the pinch rollers are not raised, problematic wrinkles and creases are formed on the medium.

Meanwhile, when the medium is a piece of cloth, the transfer of the medium at the time of media transfer becomes unstable if the drive rollers and pinch rollers pinch loose threads at an end of the piece of cloth. In this case, the previously-described printing apparatus is not useful because all pinch rollers are raised or lowered at the same time. Hence, with the previously-described printing apparatus, it is not possible to raise only a portion of the pinch rollers that are located at the end of the piece of cloth which pinch the loose threads.

Accordingly, what is needed is a printing apparatus to solve the various problems of the prior art described above, the object of which is to provide a pinch roller lifting mechanism that is capable of selecting pinch rollers to be raised or lowered, and facilitating the operation of raising and lowering the pinch rollers.

SUMMARY OF THE INVENTION

The present invention is related to a pinch roller lifting mechanism that allows pinch rollers of a printing apparatus to be raised or lowered to be selected, and therefore allowing the work of lifting and lowering the pinch rollers to be readily conducted.

Additional features and advantages of the invention will be set forth in the description which follows, and in part will be apparent from the description, or may be learned by practice of the invention. The objectives and other advantages of the invention will be realized and attained by the structure particularly pointed out in the written description and claims hereof as well as the appended drawings.

To achieve these and other advantages and in accordance with the purpose of the present invention, as embodied and broadly described, the present invention is embodied in a pinch roller lifting mechanism comprising a plurality of drive rollers for holding and transferring a medium, the plurality of drive rollers arranged adjacent to each other along a first axis; a plurality of pinch rollers for holding the medium with the plurality of drive rollers; a plate-like member extending along the first axis, wherein the plate-like member includes an opening; a support member having a first end section on which the plurality of pinch rollers are provided; a cam slidably provided on the plate-like member, the cam comprising a guide section that abuts against a second end section of the support member and engages the opening of the plate-like member; a pulley operationally connected to a drive motor for pulling the plate-like member in a first direction; and a spring that biases the plate-like member in a direction opposite to the first direction.

In one aspect of the invention, the guide section comprises a first area that facilitates the plurality of pinch rollers provided on the first end section of the support member to elastically contact the plurality of drive rollers when the second end section of the support member is positioned in the first area; a second area that raises the first end section of the support member when the second end section of the support member is positioned in the second area; and a third area that fixes the first end section of the support member in a raised state when the second end section of the support member is positioned in the third area.

In another aspect of the invention, the first area is adjacent to the second area, and the second area is adjacent to the third area. Accordingly, the guide section may further comprise a protruded section between the second area and the third area for deterring the second end section of the support member from being readily guided from the second area to the third area.

In a further aspect of the invention, the cam is moved to cause the second end section of the support member to be positioned in the first area of the guide section when the plurality of pinch rollers are to be raised or lowered, and the cam is moved to cause the second end section of the support member to be positioned in the third area of the guide section when the plurality of pinch rollers are to be maintained in the raised state.

In one aspect of the invention, when the second end section of the support member is positioned in the first area, the drive motor is driven to move the cam together with the plate-like member to raise the plurality of pinch rollers, and when the second end section of the support member is positioned in the third area, driving the drive motor does not move the cam, and the plurality of pinch rollers are maintained in the raised state.

In another aspect of the invention, when the second end section of the support member is positioned in the first area, the drive motor is driven to cause the pulley to pull the plate-like member in the first direction, whereby the cam together with the plate-like member move in the first direction, and thereby positioning the second end section of the support member in the second area of the guide section and raising the first end section of the support member.

In a further aspect of the invention, when driving the drive motor ceases, the pulley releases its pull on the plate-like member in the first direction, and the cam together with the plate-like member move in a direction opposite to the first direction according to a biasing force of the spring, thereby positioning the second end section of the support member in the first area of the guide section and lowering the first end section of the support member.

In one aspect of the invention, when the second end section of the support member is positioned in the third area, the first end section of the support member is maintained in the raised state, and the cam does not move with the plate-like member when the plate-like member is moved by the pulley when the drive motor is driven.

In another aspect of the invention, the support member is rotatably supported on a support shaft provided in parallel with the plate-like member. In a further aspect of the invention, the first end section of the support member and the second end section of the support member are mutually biased in opposite directions.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention. Features, elements, and aspects of the invention that are referenced by the same numerals in different figures represent the same, equivalent, or similar features, elements, or aspects in accordance with one or more embodiments.

DETAILED DESCRIPTION OF THE PREFERRED EMBODIMENTS

A pinch roller lifting mechanism in accordance with embodiments of the present invention will be described below in detail with reference to the accompanying drawings. In the description below, the term "medium" includes not only various types of recording media made of paper such as ordinary paper, but also various types of material, such as resin material including PVC, polyester and the like, metallic material including aluminum, iron and the like, fabrics, woods, and others.

Figure 1:
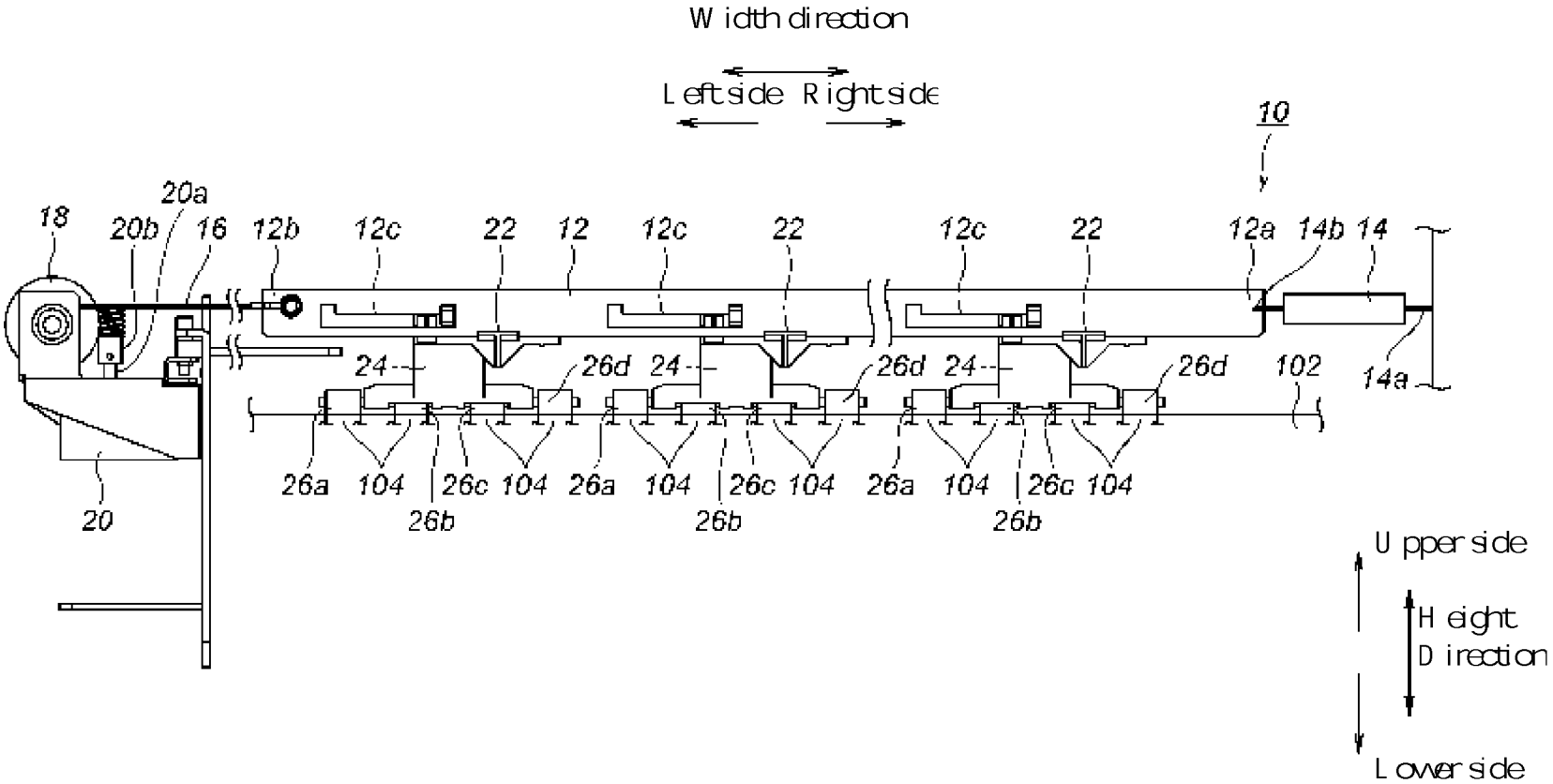
FIG. 1 is a schematic structural view of a printing apparatus equipped with a pinch roller lifting mechanism in accordance with an embodiment of the invention.

Referring to FIG. 1, a pinch roller lifting mechanism 10 is disposed in a printing apparatus having an ink head (not shown) for ejecting ink. The pinch roller lifting mechanism 10 includes a plurality of drive rollers 104 linearly arranged at predetermined intervals on a platen 102. The platen 102 extends in a direction parallel to a moving direction of the ink head, for example. The pinch roller lifting mechanism 10 further includes pinch rollers 26*a*, 26*b*, 26*c* and 26*d* arranged to be brought into elastic contact with the drive rollers 104.

The pinch roller lifting mechanism 10 includes a plate-like member 12 having an end section 12*a* connected to a spring 14 and another end section 12*b* connected to a wire 16. The pinch roller lifting mechanism 10 also includes a winding roller 18 for winding the wire 16, a drive motor 20 for driving the winding roller 18, cams 22 that are freely and slidably mounted at opening sections 12*c* formed in the plate-like member 12, and support members 24. Each of the support members 24 includes an end section 24*a* (see FIGS. 4-11) that abuts against a cam 22 and another end section 24*b* that is coupled with the pinch rollers 26*a*, 26*b*, 26*c* and 26*d*.

Figure 2:
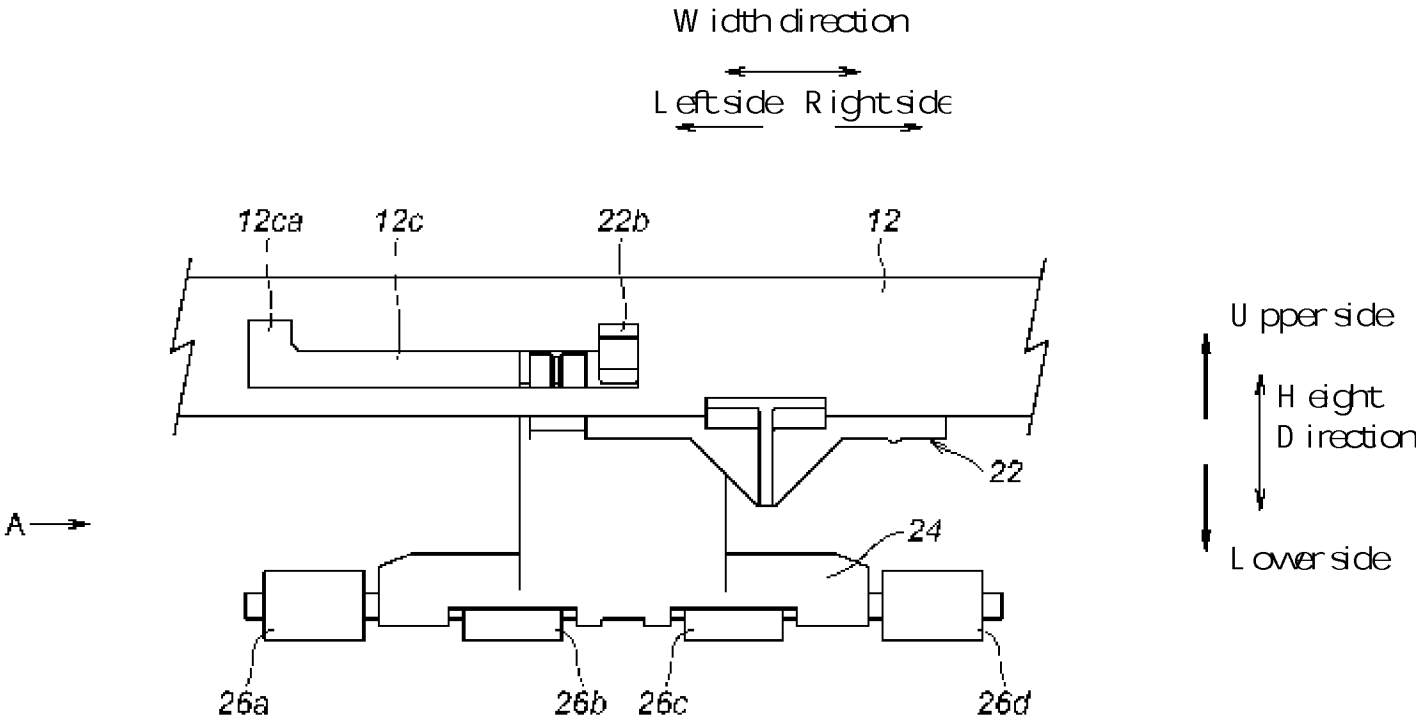
FIG. 2 is a schematic structural view of the pinch roller lifting mechanism in a state in which pinch rollers are brought into elastic contact with drive rollers in accordance with an embodiment of the invention.

Referring to FIGS. 1 and 2, the plate-like member 12 defines the opening sections 12*c*. Each opening section 12*c* is generally L-shaped and extends upwardly at a left side end section thereof. Also, each opening 12*c* opens along a width direction, wherein a retaining section 22*b* of the cam 22 engages the opening section 12*c* freely and slidably in the width direction.

The number of opening sections 12*c* provided in the plate-like member 12 is the same as the number of drive rollers 104 provided on the printing apparatus. The retaining section 22*b* of the cam 22 is inserted in an expanded section 12*ca* that expands at the left side end section of the opening section 12*c*, whereby the plate-like member 12 and the cam 22 engage one another.

The spring 14 includes an end 14*a* fixedly connected to the printing apparatus and another end 14*b* connected to the end section 12*a* of the plate-like member 12. The spring 14 is disposed in a manner to bias the plate-like member 12 to the right.

The other end section 12*b* of the plate-like member 12 is connected to the wire 16. The wire 16 is connected to the winding roller 18 that is driven by the drive motor 20. The drive motor 20 is configured such that an operator can switch between driving the drive motor 20 and stopping the drive motor 20 by depressing a switch. The switch may be provided at a location on the printing apparatus readily accessible by the operator.

The drive motor 20 includes an upwardly extending rotary shaft 20*a* and a pulley 20*b* formed with a pulley groove attached to a tip portion of the rotary shaft 20*a*. The pulley groove formed on the pulley 20*b* is formed in a manner to engage a roller groove formed on the winding roller 18. As the drive motor 20 is driven, the rotary shaft 20*a* rotates together with the pulley 20*b*, whereby the winding roller 18 is rotated.

Figure 6:
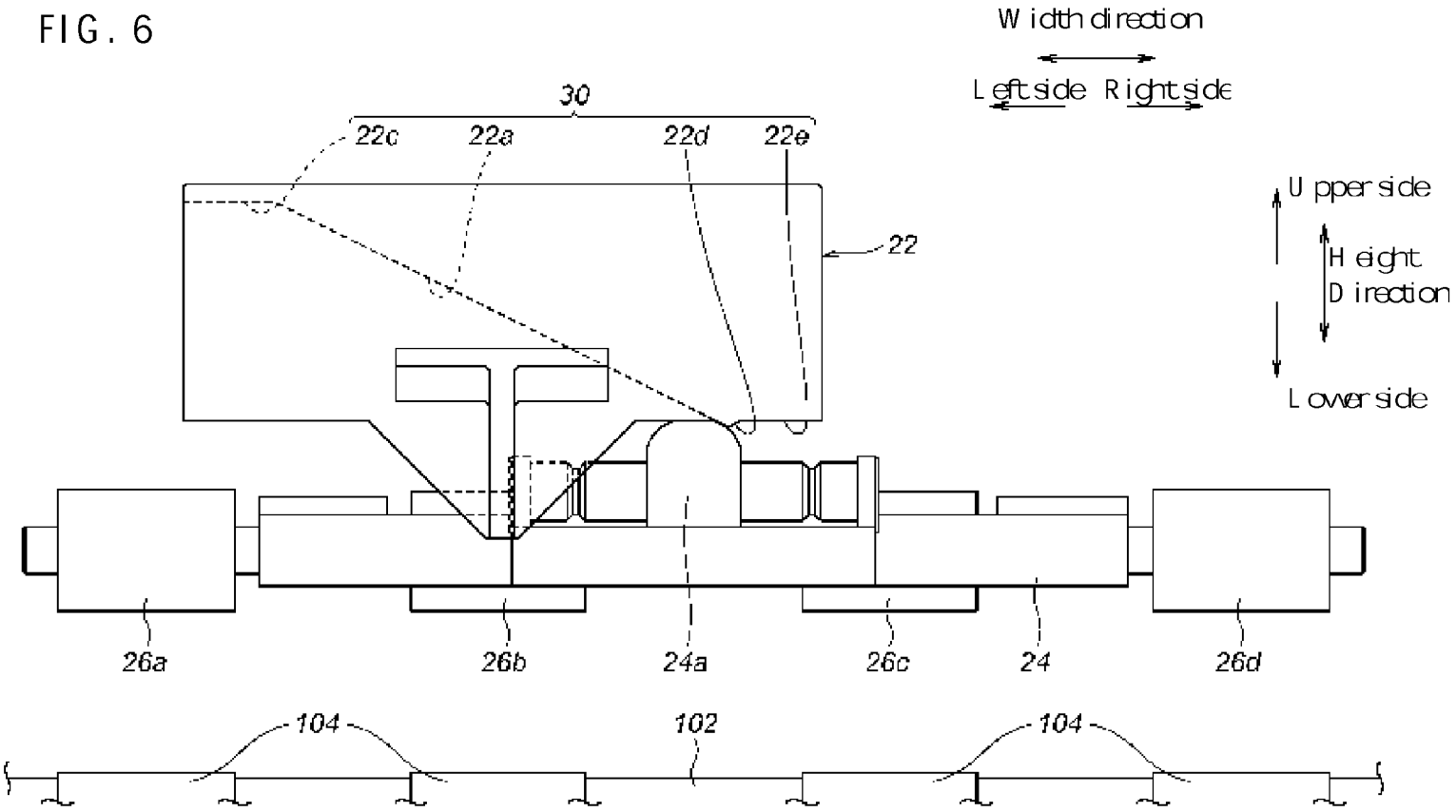
FIG. 6 is a view of an abutted state between the support member and the cam of the pinch roller lifting mechanism in the state shown in FIG. 5 in accordance with an embodiment of the invention.

Referring to FIG. 6, the cam 22 is formed with a guide section 30 that protrudes to a rear of the printing apparatus and guides an end section 24*a* of the support member 24. The guide section 30 includes a first flat surface 22*c* at a left side of the cam 22 near an upper end section thereof. A second flat surface 22*e* of the guide section 30 is provided at a right side of the cam 22 near a lower end section thereof. Furthermore, the guide section 30 includes a sloped surface 22*a* that slopes down from the first flat surface 22*c* toward the second flat surface 22*e*. The guide section also includes a protruded section 22*d* at a portion of the cam 22 where the sloped surface 22*a* intersects the second flat surface 22*e*.

Referring to FIGS. 3, 4, 7 and 10, the cam 22 also includes a knob section 22*f* that protrudes to a front of the printing apparatus that may work in conjunction with the retaining section 22*b*. As stated above, the retaining section 22*b* engages with the opening section 12*c* allowing the cam 22 to freely and slidably engage the plate-like member 12. Thus, the knob section 22*f* may be held and moved by the operator to move the cam 22 to the right or left, and within the range, of the opening section 12*c* in which the retaining section 22*b* can be slidably moved.

Figure 4:
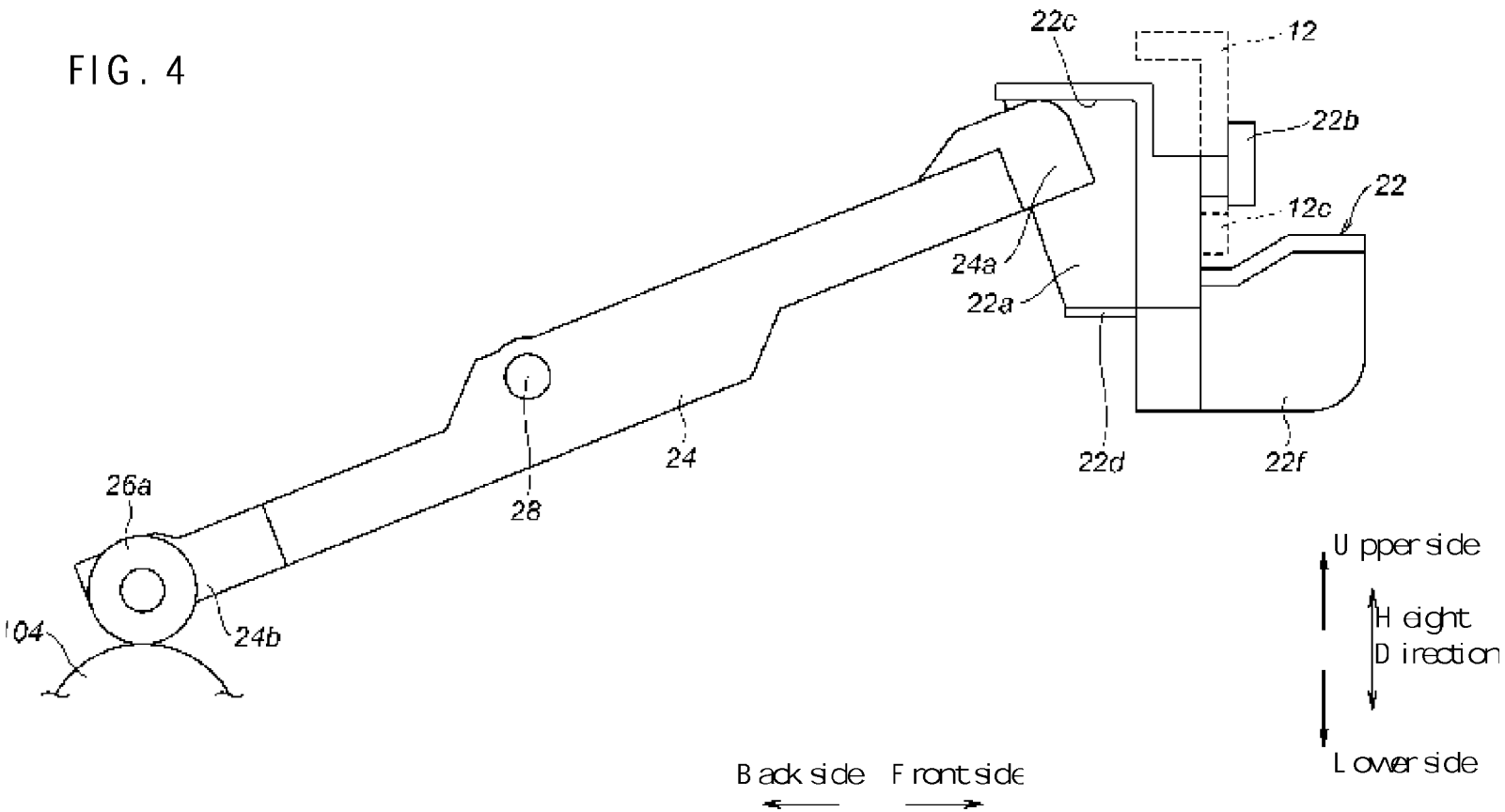
FIG. 4 is a view of the pinch roller lifting mechanism from the perspective of arrow A in FIG. 2 in accordance with an embodiment of the invention.
Figure 5:
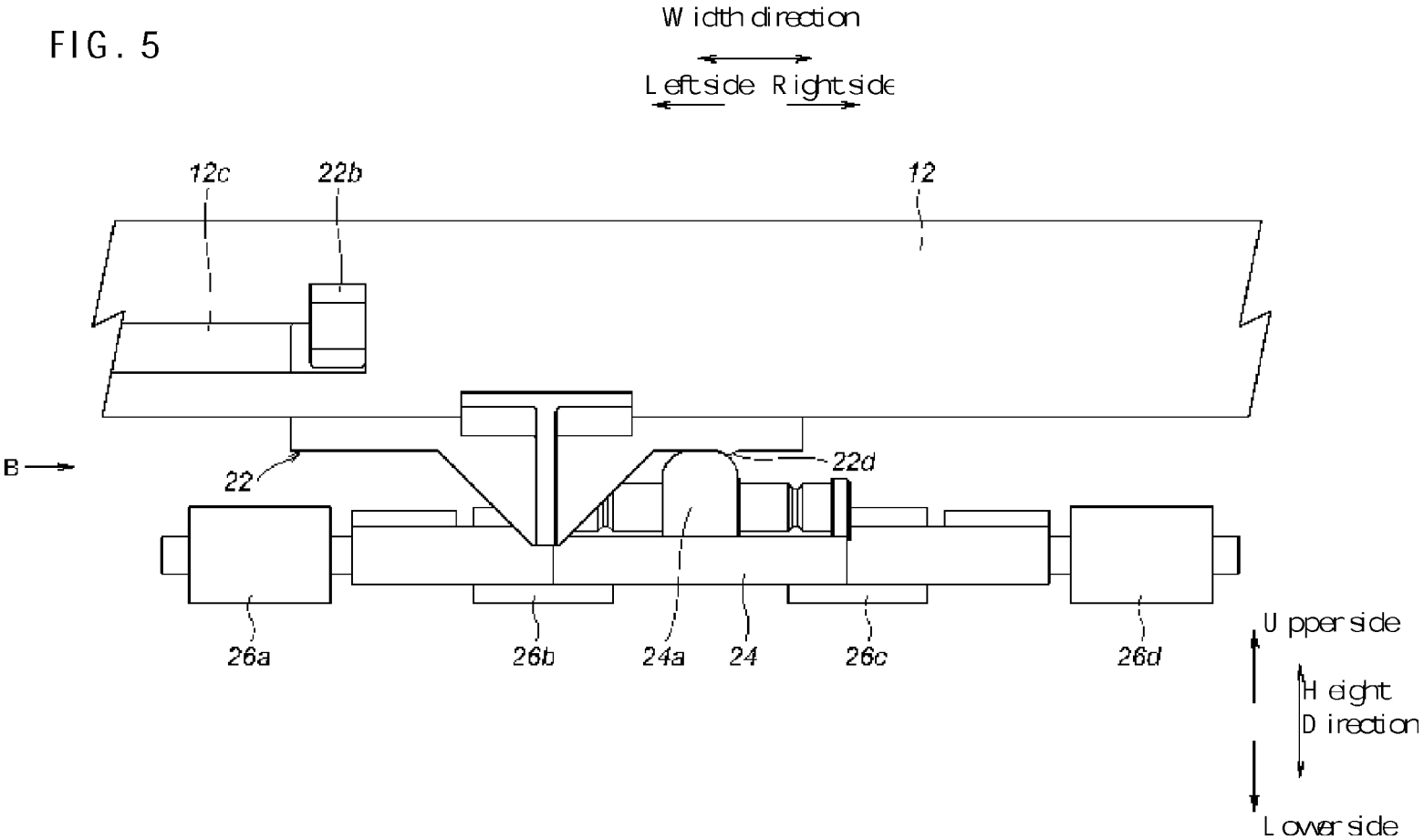
FIG. 5 is a schematic structural view of the pinch roller lifting mechanism when the elastic contact between the pinch rollers and the drive rollers is released in accordance with an embodiment of the invention.
Figure 7:
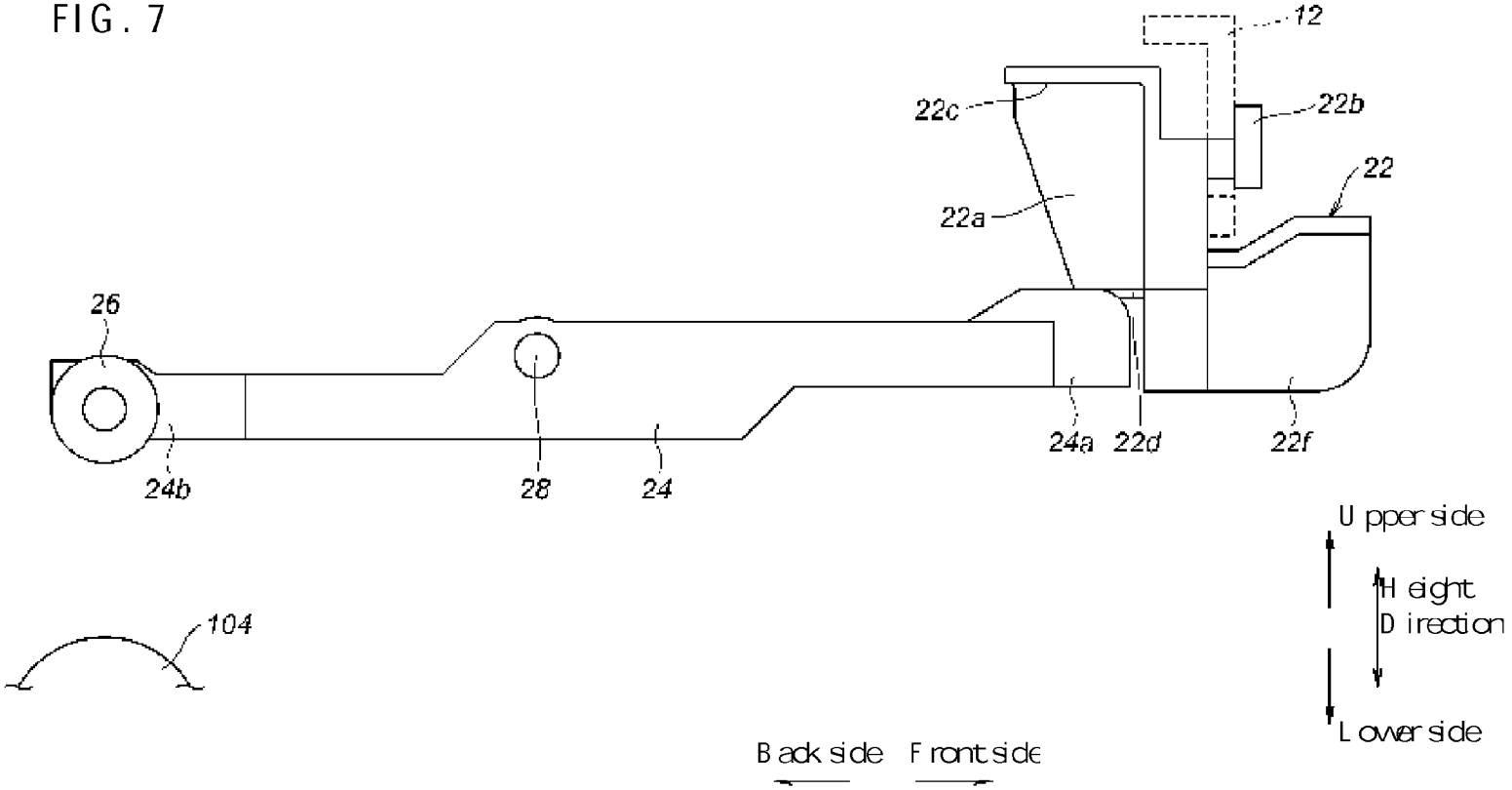
FIG. 7 is a view of the pinch roller lifting mechanism from the perspective of arrow B in FIG. 5 in accordance with an embodiment of the invention.
Figure 10:
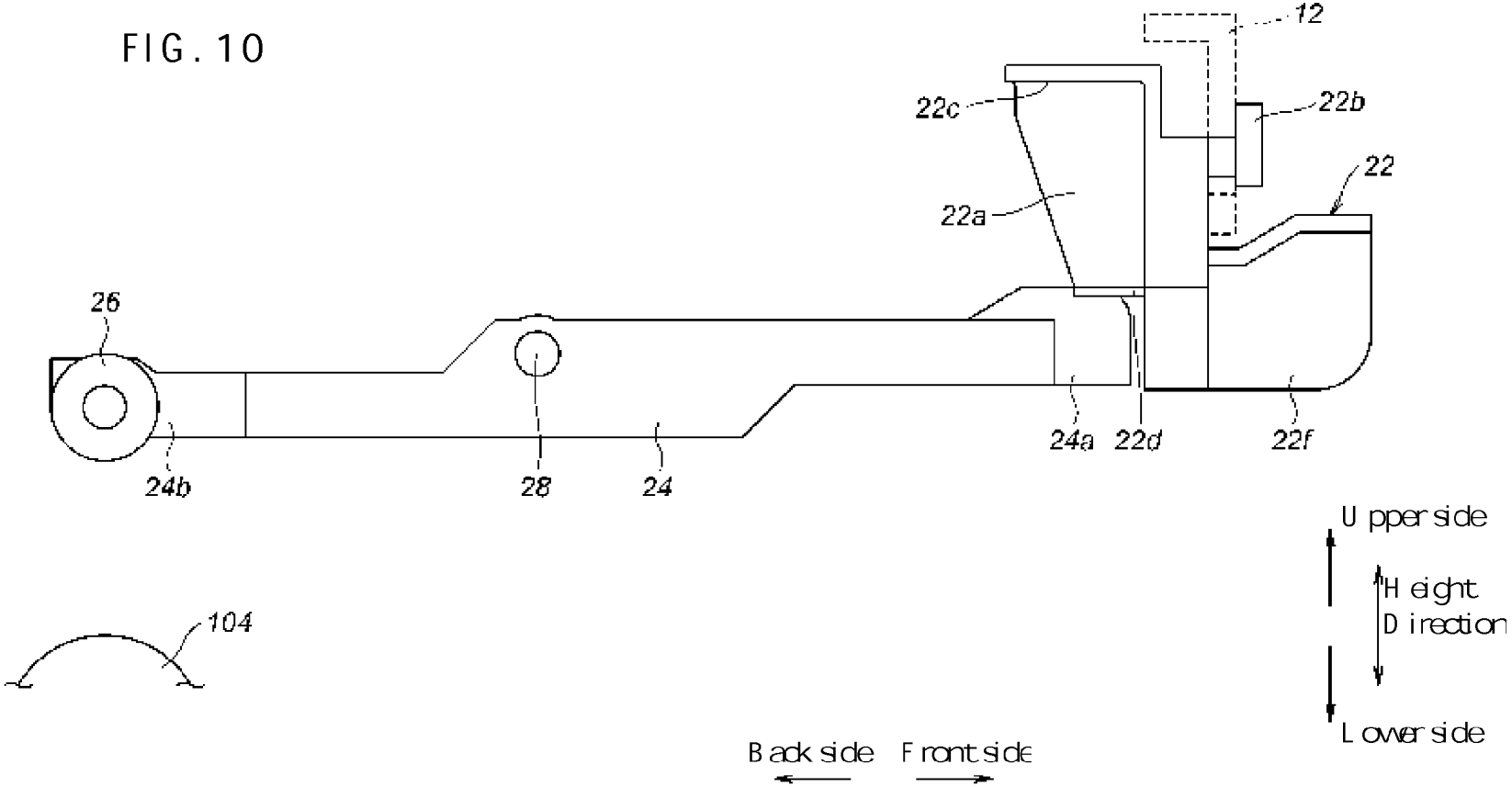
FIG. 10 is a view of the pinch roller lifting mechanism from the perspective of arrow C in FIG. 8 in accordance with an embodiment of the invention.
Figure 11:
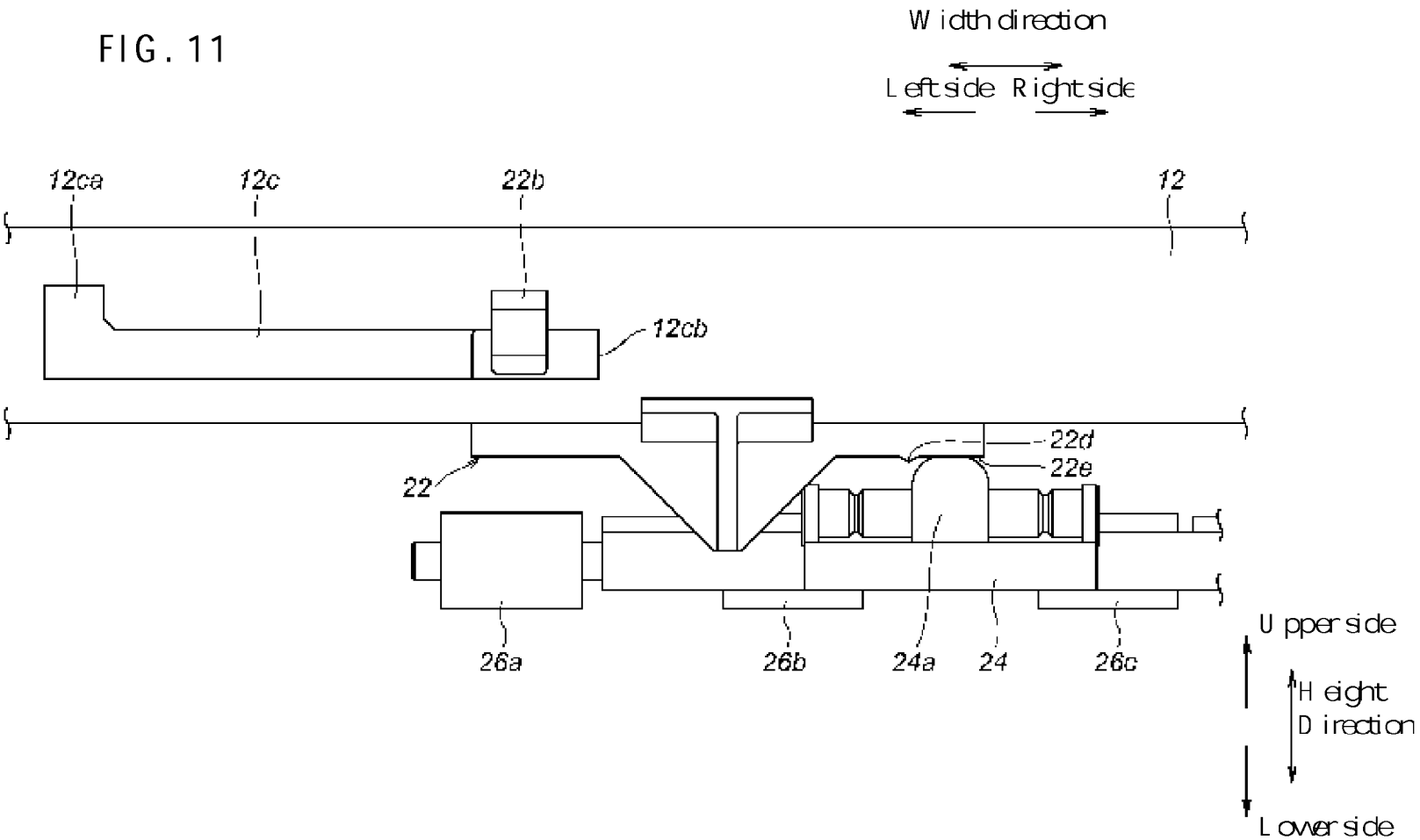
FIG. 11 is a view of the pinch roller lifting mechanism in which the plate-like member is moved to the left when the support member is fixed by the cam in accordance with an embodiment of the invention.

Referring to FIGS. 4, 7 and 10, the support member 24 is rotatably mounted on a support shaft 28 that is provided in parallel with the plate-like member 12. One end section 24*a* of the support member 24 is provided with the four pinch rollers 26*a*, 26*b*, 26*c* and 26*d*. The other end section 24*b* of the support member 24 is positioned to contact the first flat surface 22*c*, the sloped surface 22*a*, the protruded section 22*d* and the second flat surface 22*e* of the guide section 30 of the cam 22. Moreover, the support member 24 is arranged in a state in which the other end section 24*b* of the support member 24 is biased downwardly about the support shaft 28 and the end section 24*a* of the support member 24 is biased upwardly about the support shaft 28. The end sections may be biased using a coil spring (not shown) or the like, for example.

As described above, the pinch rollers are raised or lowered by the pinch roller lifting mechanism in accordance with embodiments of the present invention. In an embodiment, the pinch roller lifting mechanism 10 enables all pinch rollers at their respective transfer mechanisms to be raised or lowered at the same time.

To lift all the pinch rollers of the respective transfer mechanisms at the same time, the operator may push a switch (not shown) provided on the printing apparatus to drive the drive motor 20. As the drive motor 20 is driven, the rotary shaft 20*a* is rotated thereby rotating the pulley 20*b*. As the pulley 20*b* is rotated, the winding roller 18 is rotated to wind the wire 16. When the wire 16 is wound by the winding roller 18, the plate-like member 12 that is connected to the wire 16 moves to the left.

The retaining sections 22*b* are located at the right side end sections of the opening sections 12*c* of the plate-like member 12, and are pushed to the left by right side end edges 12*cb* of the opening sections 12*c* (see FIGS. 8 and 11), such that the cams 22 also move to the left together with the plate-like member 12. As the cams 22 move to the left, the end sections 24*a* of the support members 24 that have been in contact with the first flat surfaces 22*c* of the cams 22 move from the first flat surfaces 22*c* to the sloped surfaces 22*a*, and move to a position where they abut against the protruded sections 22*b* located at the lower end of the sloped surfaces 22*a* (see FIGS. 5-7).

Accordingly, the end sections 24*a* of the support members 24 abut against the protruded sections 22*d* of the cams 22 while being positioned in the sloped surfaces 22*a* that slope down to the right, and are biased upwardly about the support shafts 28. Therefore, the cams 22 are placed in a state of being biased to the right by the support members 24.

It is noted that the drive motor 20 is preset with an amount of drive such that the end sections 24*a* of the support members 24 will not ride over the protruded sections 22*d* of the cams 22 and will not be positioned on the second flat surfaces 22*e* when the wire 16 is wound on the winding roller 18. Further, the drive motor 20 is preset with enough drive force to pull the plate-like member 12 to the left against the right biasing force of the spring 14 and the right biasing force working on the cams 22 when the end sections 24*a* of the support members 24 are positioned on the sloped surfaces 22*a*.

As the end sections 24*a* move from the first flat surfaces 22*c* to the sloped surfaces 22*a*, the support members 24 rotate about the support shafts 28, whereby the other end sections 24*b* move upward such that the pinch rollers 26*a*, 26*b*, 26*c* and 26*d* are raised.

By the operation described above, the state of elastic contact between the pinch rollers 26*a*, 26*b*, 26*c* and 26*d* and the drive rollers 104 in the respective transfer mechanisms is released at the same time. After the pinch rollers 26*a*, 26*b*, 26*c* and 26*d* are raised, the released state of elastic contact between the pinch rollers 26*a*, 26*b*, 26*c* and 26*d* and the drive rollers 104 is maintained while the drive motor 20 is driven.

While in this state, the operator may perform required work on the medium, such as correction of the medium's disposed position, correction of the medium's disposed orientation, and the like.

When the operator finishes the required work, the operator may press a switch provided on the printing apparatus to stop the drive of the drive motor 20. By this, the plate-like member 12 moves to the right by the biasing force of the spring 14, and the wire 16 wound on the winding roller 18 is pulled out by the biasing force of the spring 14. In this instance, the drive motor 20 is set to run idle.

Figure 3:
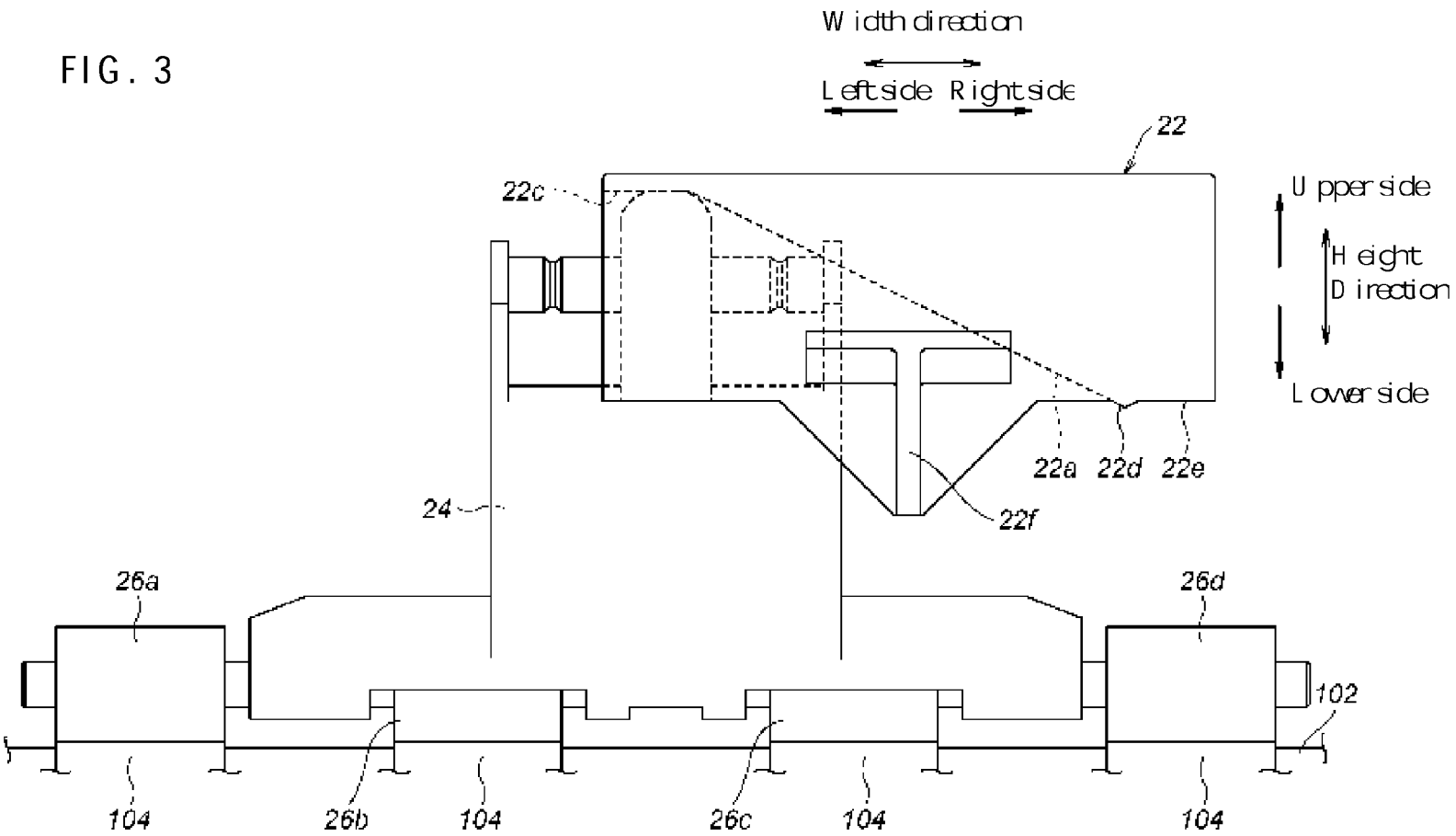
FIG. 3 is a view of an abutted state between a support member and a cam of the pinch roller lifting mechanism in the state shown in FIG. 2 in accordance with an embodiment of the invention.

As the plate-like member 12 further moves to the right, the end sections 24*a* of the support members 24 that have been abutting the protruded sections 22*d* of the cams 22, and located at the lower end of the sloped surfaces 22*a* of the cams 22, move along the sloped surfaces 22*a* and are brought into contact with the first flat surfaces 22*c* of the cams 22 (see FIGS. 2-4).

As the end sections 24*a* of the support members 24 move from the lower end of the sloped surfaces 22*a* to the first flat surfaces 22*c* located at the upper end of the sloped surfaces 22*a*, the support members 24 rotate about the support shafts 28, whereby the other end sections 24*b* move downwardly, thereby lowering the pinch rollers 26*a*, 26*b*, 26*c* and 26*d*. As a result, the pinch rollers 26*a*, 26*b*, 26*c* and 26*d* in the respective transfer mechanisms are brought into elastic contact with the drive rollers 104.

In accordance with an embodiment of the present invention, the pinch roller lifting mechanism 10 allows the operator to select, among the plurality of transfer mechanisms each comprising pinch rollers and drive rollers, transfer mechanisms which transfer media having the pinch rollers and drive rollers in elastic contact with each other, and transfer mechanisms which do not transfer media having a released elastic contact between the pinch rollers and drive rollers released.

According to an embodiment, the operator may select one of the transfer mechanisms that does not transfer media, wherein the pinch rollers and drive rollers are released from elastic contact with each other. Accordingly, in the selected transfer mechanism, the operator may hold the knob section 22*f* of the cam 22 that is in contact with the end section 24*a* of the support member 24 provided with the pinch rollers and move only the cam 22 to the left without moving the plate-like member 12.

In this instance, the cam 22 moves to the left as the retaining section 22*b* is guided by the opening section 12*c* of the plate-like member 12. Then, the operator moves the cam 22 to the left until the end section 24*a* of the support member 24 rides over the protruded section 22*d* and is located on the second flat surface 22*e* (see FIGS. 8-10).

As the cam 22 is moved and the end section 24*a* of the support member 24 is positioned on the second flat surface 22*e*, the support member 24 rotates about the support shaft 28, whereby the other end section 24*b* moves upward. In this instance, no biasing force to the right is generated at the cam 22.

By this operation, the support member 24 is fixed by the cam 22 in a state in which the end section 24*a* of the support member 24 is positioned on the second flat surface 22*e*, and the pinch rollers 26*a*, 26*b*, 26*c* and 26*d* are positioned to the upper side. In other words, in the transfer mechanism which transfers the medium and has the pinch rollers and drive rollers in elastic contact with each other, the end section 24*a* of the support member 24 is positioned on the first flat surface 22*c*, the pinch rollers 26*a*, 26*b*, 26*c* and 26*d* elastically contact the drive rollers, and the support member 24 is not fixed by the cam 22, as in the case described above of raising or lowering all pinch rollers at the same time.

In contrast, in the transfer mechanism which does not transfer the medium and has the pinch rollers and drive rollers released from elastic contact with each other, the support member 24 is fixed by the cam 22 in a state in which the end section 24*a* of the support member 24 is positioned on the second flat surface 22*e*, and the pinch rollers 26*a*, 26*b*, 26*c* and 26*d* are raised.

After the operator has fixed the support member 24 on the cam 22 in the selected transfer mechanism, the pinch rollers in another transfer mechanism in which the support member 24 is not fixed on the cam 22 may be raised or lowered. Such an operation is the same as the operation for raising or lowering all the pinch rollers at the same time as described above, and therefore detailed description thereof shall be omitted.

Figure 8:
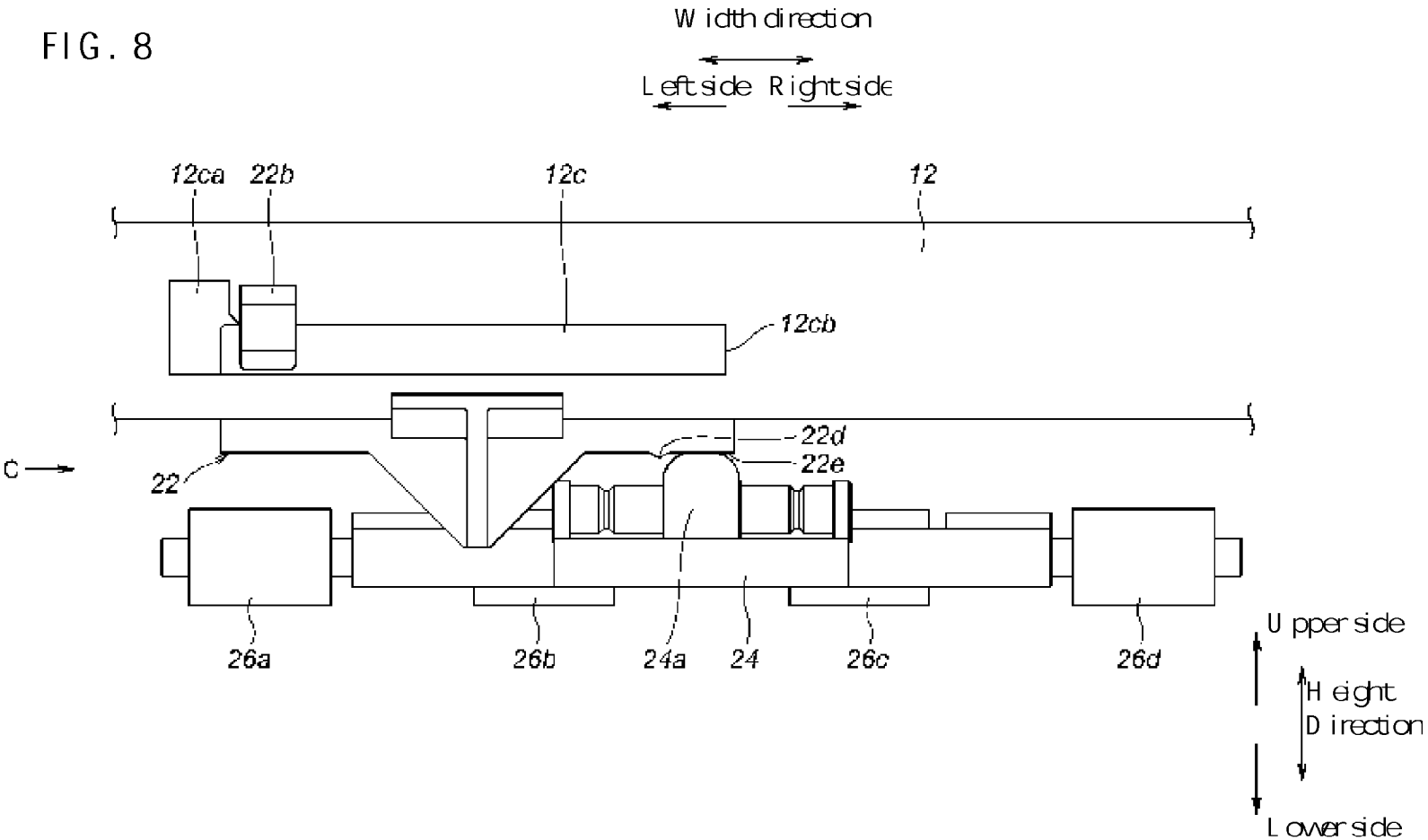
FIG. 8 is a schematic structural view of the pinch roller lifting mechanism in a state in which the pinch rollers cannot be lowered in accordance with an embodiment of the invention.
Figure 9:
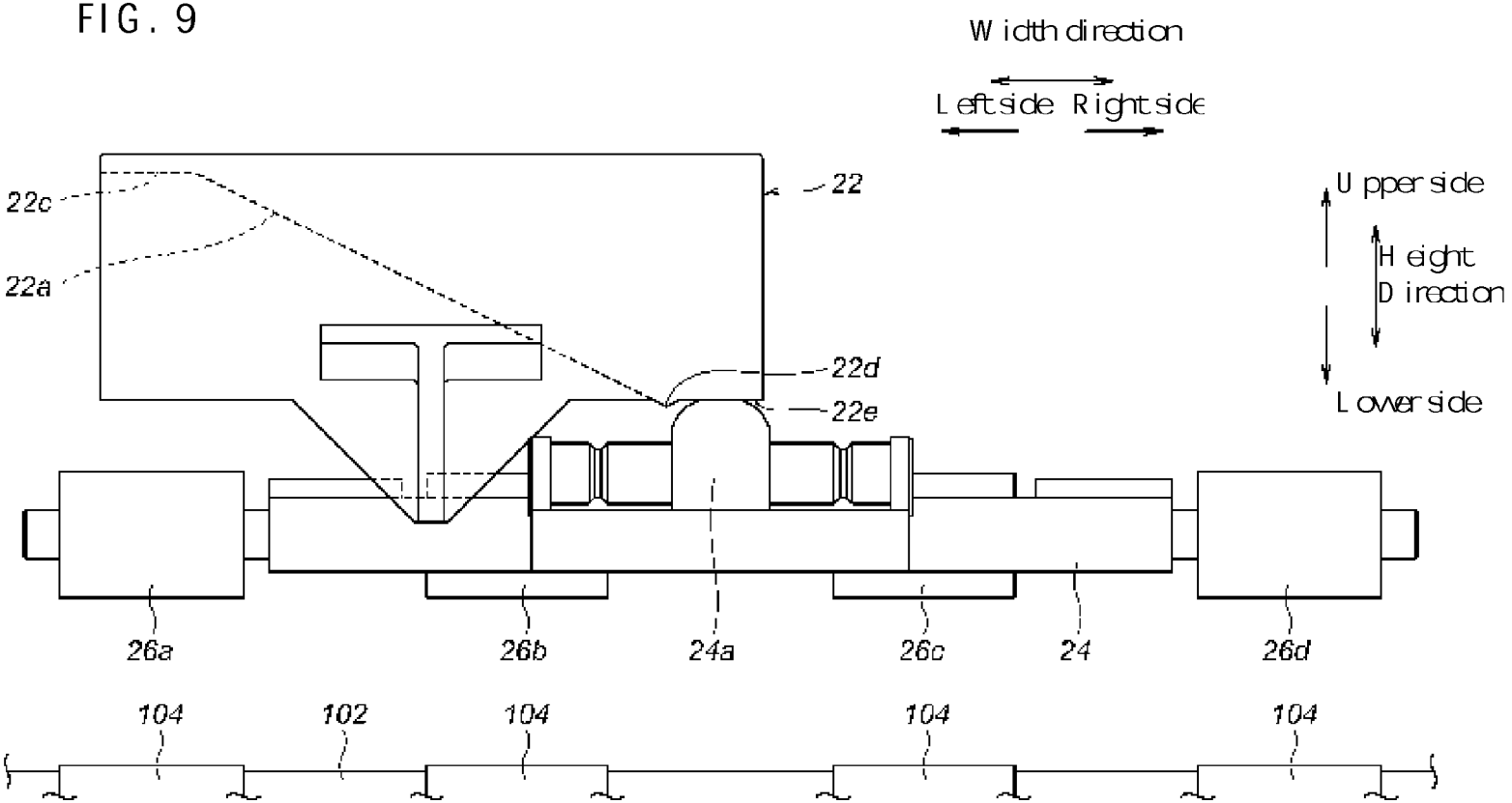
FIG. 9 is a view of an abutted state between the support member and the cam of the pinch roller lifting mechanism in the state shown in FIG. 8 in accordance with an embodiment of the invention.

In the transfer mechanism with the support member 24 fixed by the cam 22, the retaining section 22*b* of the cam 22 is positioned near the expanded section 12*ca* of the opening 12*c* in the plate-like member 12 (see FIG. 8). Therefore, even when the operator pushes the switch (not shown) provided on the printing apparatus to drive the drive motor 20 to move the plate-like member 12 to the left, and the plate-like member 12 moves to the left, the retaining section 22 does not come into contact with the right side edge 12*cb* of the opening section 12*c* (see FIG. 11). Accordingly, the support member 24 that is fixed by the cam 22 does not cause the cam 22 to move to the left even when the plate-like member 12 is moved to the left, and the support member 24 is maintained in the state in which the other end section 24*b* is raised by the cam 22.

Thereafter, when the operator finishes any required work in the state in which the pinch rollers 26*a*, 26*b*, 26*c* and 26*d* are raised in the transfer mechanism whose support member 24 is not fixed by the cam 22, the operator may press the switch provided on the printing apparatus to stop driving the drive motor 20. The plate-like member 12 then moves to the right by the biasing force of the spring 14. However, at this moment, the biasing force to the right is not generated on the cam 22, such that the cam 22 does not move to the right together with the plate-like member 12. Then, the supporting member 24 continues maintaining the state in which the other end section 24*b* is raised. In this manner, in the transfer mechanisms in which the pinch rollers and drive rollers are not in elastic contact with each other, and do not transfer the medium, the pinch rollers are not raised or lowered.

In the transfer mechanism with the support member 24 fixed by the cam 22 in the state in which the pinch rollers 26*a*, 26*b*, 26*c* and 26*d* are raised, in other words, in the transfer mechanism in which the pinch rollers are not in elastic contact with the drive rollers and does not transfer the medium, the operator can hold and move the knob section 22*f* to move only the cam 22 to the right without moving the plate-like member 12. Accordingly, the one end section 24*a* is moved from the second flat surface 22*e* to the first flat surface 22*c*, whereby the fixed state of the support member 24 by the cam 22 is released. The transfer mechanism in which the fixed state of the support member 24 by the cam 22 is released can be placed in a state in which the pinch rollers are raised or lowered.

As described above, the pinch roller lifting mechanism 10 in accordance with an embodiment of the invention includes the plate-like member 12 with one end section 12*a* fixed to the spring 14 that biases the plate-like member 12 to the right, and another end section 12*b* connected to the wire 16 that can be wound by the drive of the drive motor 20. The cams 22 are slidably provided by engaging the retaining sections 22*b* with the opening sections 12*c* provided at predetermined plural locations of the plate-like member 12. The support member 24 is rotatably provided about the support shaft 28, and has the one end section 24*a* configured to be abutted against the guide section 30 formed in the cam 22 and the other end section 24*b* provided with four pinch rollers.

By moving the plate-like member 12 via winding the wire 16 driven by the drive motor 20, the end section 24*a* of the support member 24 is moved at the guide section 30 from the first flat surface 22*c* to the sloped surface 22*a* and is then positioned near the protruded section 22*d*. By this, the support member 24 rotates about the support shaft 28, thereby raising the pinch rollers provided on the other end section 24*b* of the support member 24.

As the drive of the drive motor 20 is stopped, the plate-like member 12 moves to the right by the biasing force of the spring 14, whereby the end section 24*a* of the support member 24 moves at the guide section 30 from the sloped surface 22*a* to the first flat surface 22*c*. By this, the support member 24 rotates about the support shaft 28, thereby lowering the pinch rollers provided on the other end section 24*b* of the support member 24.

Further, the cam 22 may be moved to the right within the range of the opening section 12*c* to position the end section 24*a* of the support member 24 in the second flat surface 22*e* of the guide section 30, whereby the support member 24 can be fixed by the cam 22. Therefore, in the transfer mechanism with the cam 22 moved to the right, the support member 24 maintains its fixed state, and the pinch rollers cannot be raised or lowered even when the plate-like member 12 is moved to the left or right.

Therefore, in the pinch roller lifting mechanism according an embodiment of the invention, the pinch rollers can be raised or lowered by driving the drive motor 20. Thus, an operator without any work experience with respect to a printing apparatus implementing the pinch roller lifting mechanism 10 can readily and appropriately perform the work of raising and lowering the pinch rollers.

Further, in the pinch roller lifting mechanism according to an embodiment of the invention, the operator may decide between transfer mechanisms in which the pinch rollers are to be raised or lowered and transfer mechanisms in which the pinch rollers are not to be raised or lowered. Therefore, a medium can be held between the pinch rollers and drive rollers 104 of a transfer mechanism in which the pinch rollers are to be raised or lowered. Moreover, the transfer mechanisms in which the pinch rollers are to be raised or lowered may be selectively changed depending on the types of media.

Therefore, the pinch roller lifting mechanism 10 in accordance with embodiments of the invention proves to be a technology with greater flexibility, compared to the pinch roller lifting mechanisms of the conventional art.

Embodiments of the invention can be used in printing apparatuses and the like equipped with a transfer mechanism having pinch rollers that, together with drive rollers, pinch and hold a medium. The embodiments of the invention enable selection of pinch rollers to be raised or lowered, and to facilitate the work of raising and lowering pinch rollers.

A pinch roller lifting mechanism includes a plate-like member defining an opening section, a support member having one end section and another end section that is provided with pinch rollers, a cam provided on the plate-like member, engaging the opening section, and having a guide section arranged in a manner to abut against the one end section of the support member, a pulling device that pulls the plate-like member in a predetermined direction, and a spring that biases the plate-like member in a direction opposite to the predetermined direction. The guide section includes a first area that allows the pinch rollers to elastically contact drive rollers, a second area that raises the other end section, and a third area that fixes the other end section in a raised state. When the operator moves the cam such that the one end section is positioned in the first area, the operator controls the drive device to move the cam together with the plate-like member, thereby raising the other end section. But when the one end section is positioned in the third area, the cam does not move and the other end section is maintained in a raised state even when the operator controls the drive device to move the plate-like member.

The foregoing embodiments and advantages are merely exemplary and are not to be construed as limiting the present invention. The present teaching can be readily applied to other types of apparatuses. The description of the present invention is intended to be illustrative, and not to limit the scope of the claims. Many alternatives, modifications, and variations will be apparent to those skilled in the art. In the claims, means-plus-function clauses are intended to cover the structure described herein as performing the recited function and not only structural equivalents but also equivalent structures.

What is claimed is:

1. A pinch roller lifting mechanism comprising:

a plurality of drive rollers for holding and transferring a medium, the plurality of drive rollers arranged adjacent to each other along a first axis;

a plurality of pinch rollers for holding the medium with the plurality of drive rollers;

a plate-like member extending along the first axis, wherein the plate-like member includes an opening;

a support member having a first end section on which the plurality of pinch rollers are provided;

a cam slidably provided on the plate-like member, the cam comprising a guide section that abuts against a second end section of the support member and engages the opening of the plate-like member;

a pulley operationally connected to a drive motor for pulling the plate-like member in a first direction; and a spring that biases the plate-like member in a direction opposite to the first direction.

2. The pinch roller mechanism of claim 1, wherein the guide section comprises:

a first area that facilitates the plurality of pinch rollers provided on the first end section of the support member to elastically contact the plurality of drive rollers when the second end section of the support member is positioned in the first area;

a second area that raises the first end section of the support member when the second end section of the support member is positioned in the second area; and a third area that fixes the first end section of the support member in a raised state when the second end section of the support member is positioned in the third area.

3. The pinch roller mechanism of claim 2, wherein the first area is adjacent to the second area, and the second area is adjacent to the third area.

4. The pinch roller mechanism of claim 3, wherein the guide section further comprises a protruded section between the second area and the third area for deterring the second end section of the support member from being readily guided from the second area to the third area.

5. The pinch roller mechanism of claim 2, wherein the cam is moved to cause the second end section of the support member to be positioned in the first area of the guide section when the plurality of pinch rollers are to be raised or lowered, and wherein the cam is moved to cause the second end section of the support member to be positioned in the third area of the guide section when the plurality of pinch rollers are to be maintained in the raised state.

6. The pinch roller mechanism of claim 5, wherein:

when the second end section of the support member is positioned in the first area, the drive motor is driven to move the cam together with the plate-like member to raise the plurality of pinch rollers, and when the second end section of the support member is positioned in the third area, driving the drive motor does not move the cam, and the plurality of pinch rollers are maintained in the raised state.

7. The pinch roller mechanism of claim 6, wherein when the second end section of the support member is positioned in the first area, the drive motor is driven to cause the pulley to pull the plate-like member in the first direction, whereby the cam together with the plate-like member move in the first direction, and thereby positioning the second end section of the support member in the second area of the guide section and raising the first end section of the support member.

8. The pinch roller mechanism of claim 7, wherein when driving the drive motor ceases, the pulley releases its pull on the plate-like member in the first direction, and the cam together with the plate-like member move in a direction opposite to the first direction according to a biasing force of the spring, thereby positioning the second end section of the support member in the first area of the guide section and lowering the first end section of the support member.

9. The pinch roller mechanism of claim 6, wherein when the second end section of the support member is positioned in the third area, the first end section of the support member is maintained in the raised state, and the cam does not move with the plate-like member when the plate-like member is moved by the pulley when the drive motor is driven.

10. The pinch roller mechanism of claim 1, wherein the support member is rotatably supported on a support shaft provided in parallel with the plate-like member.

11. The pinch roller mechanism of claim 1, wherein the first end section of the support member and the second end section of the support member are mutually biased in opposite directions.

* * * * *